US007879783B2

(12) United States Patent
Wu

(10) Patent No.: US 7,879,783 B2
(45) Date of Patent: Feb. 1, 2011

(54) CLEANING COMPOSITION FOR SEMICONDUCTOR SUBSTRATES

(75) Inventor: Aiping Wu, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 602 days.

(21) Appl. No.: 11/652,407

(22) Filed: Jan. 11, 2007

(65) Prior Publication Data

US 2008/0169004 A1 Jul. 17, 2008

(51) Int. Cl.
*C11D 7/50* (2006.01)

(52) U.S. Cl. ..... 510/175; 134/1.3

(58) Field of Classification Search ..... 510/175; 134/1.3

See application file for complete search history.

(56) References Cited

U.S. PATENT DOCUMENTS

| | | | | |
|---|---|---|---|---|
| 5,698,503 | A | 12/1997 | Ward et al. | |
| 5,792,274 | A | 8/1998 | Tanabe et al. | |
| 5,905,063 | A | 5/1999 | Tanabe et al. | |
| 6,235,693 | B1 | 5/2001 | Cheng et al. | |
| 6,656,894 | B2 | 12/2003 | Peters et al. | |
| 6,773,873 | B2 | 8/2004 | Seijo et al. | |
| 6,821,352 | B2 | 11/2004 | Rovito et al. | |
| 6,828,289 | B2 | 12/2004 | Peters et al. | |
| 7,361,631 | B2 * | 4/2008 | Egbe et al. | 510/175 |
| 2003/0181342 | A1 * | 9/2003 | Seijo et al. | 510/175 |
| 2004/0016904 | A1 | 1/2004 | Baum et al. | |
| 2004/0142835 | A1 * | 7/2004 | Takashima | 510/175 |
| 2004/0266637 | A1 | 12/2004 | Rovito et al. | |
| 2005/0119143 | A1 | 6/2005 | Egbe et al. | |
| 2005/0288199 | A1 | 12/2005 | Oowada et al. | |
| 2008/0188085 | A1 * | 8/2008 | Muramatsu et al. | 438/706 |
| 2008/0214002 | A1 * | 9/2008 | Aoki et al. | 438/682 |

FOREIGN PATENT DOCUMENTS

| | | | |
|---|---|---|---|
| EP | 1 612 858 | A2 | 1/2006 |
| EP | 1 619 557 | A1 | 1/2006 |
| EP | 1 772 495 | A | 4/2007 |
| JP | 2004-094203 | | 3/2004 |
| JP | 2004-302271 | A | 10/2004 |
| KR | 20040041019 | | 5/2004 |
| KR | 20040104519 | | 12/2004 |
| WO | 00/72363 | A1 | 11/2000 |
| WO | 2006/110645 | A2 | 10/2006 |

* cited by examiner

*Primary Examiner*—Gregory E Webb
(74) *Attorney, Agent, or Firm*—Rosaleen P. Morris-Oskanian

(57) ABSTRACT

The present invention relates to a semi-aqueous cleaning composition used to remove unwanted organic and inorganic residues and contaminants from semiconductor substrates. The cleaning composition comprises a buffering system comprising a polyprotic acid having at least three carboxylic acid groups with a pKa value of about 5 to about 7. The composition also comprises a polyhydric solvent, such as glycerol. A fluoride ion source is also included in the cleaning compositions of the present invention and is principally responsible for removing inorganic residues from the substrate. The cleaning compositions of the present invention have a low toxicity and are environmentally acceptable.

21 Claims, No Drawings

CLEANING COMPOSITION FOR SEMICONDUCTOR SUBSTRATES

BACKGROUND OF THE INVENTION

The present invention provides cleaning compositions that can be used for a variety of applications including, for example, removing unwanted resist films, post-etch, and post-ash residue on a semiconductor substrate.

The background of the present invention will be described in connection with its use in cleaning applications involving the manufacture of integrated circuits. It should be understood, however, that the use of the present invention has wider applicability as described hereinafter.

In the manufacture of integrated circuits, it is sometimes necessary to etch openings or other geometries in a thin film deposited or grown on the surface of silicon, gallium arsenide, glass, or other substrate located on an in-process integrated circuit wafer. Such integrated circuits often contain porous interlayer dielectrics (ILDs). Present methods for etching such a film require that the film be exposed to a chemical etching agent to remove portions of the film. The particular etching agent used to remove the portions of the film depends upon the nature of the film. In the case of an oxide film, for example, the etching agent may be hydrofluoric acid. In the case of a polysilicon film, it will typically be hydrofluoric acid or a mixture of nitric acid and acetic acid.

In order to assure that only desired portions of the film are removed, a photolithography process is used, through which a pattern in a computer drafted photo mask is transferred to the surface of the film. The mask serves to identify the areas of the film which are to be selectively removed. This pattern is formed with a photoresist material, which is a light sensitive material spun onto the in-process integrated circuit wafer in a thin film and exposed to high intensity radiation projected through the photo mask. The exposed or unexposed photoresist material, depending on its composition, is typically dissolved with developers, leaving a pattern which allows etching to take place in the selected areas, while preventing etching in other areas. Positive-type resists, for example, have been extensively used as masking materials to delineate patterns on a substrate that, when etching occurs, will become vias, trenches, contact holes, etc.

Increasingly, a dry etching process such as, for example, plasma etching, reactive ion etching, or ion milling is used to attack the photoresist-unprotected area of the substrate to form the vias, trenches, contact holes, etc. As a result of the plasma etching process, photoresist, etching gas and etched material by-products are deposited as residues around or on the sidewall of the etched openings on the substrate.

Such dry etching processes also typically render the resist mask extremely difficult to remove. For example, in complex semiconductor devices such as advanced DRAMS and logic devices with multiple layers of back end lines of interconnect wiring, reactive ion etching (RIE) is used to produce vias through the interlayer dielectric to provide contact between one level of silicon, silicide or metal wiring to the next level of wiring. These vias typically expose, Al, AlCu, Cu, Ti, TiN, Ta, TaN, silicon or a silicide such as, for example, a silicide of tungsten, titanium or cobalt. The RIE process leaves a residue on the involved substrate comprising a complex mixture that may include, for example, re-sputtered oxide material, polymeric material derived from the etch gas, and organic material from the resist used to delineate the vias.

Additionally, following the termination of the etching step, the photoresist and etch residues must be removed from the protected area of the wafer so that the final finishing operation can take place. This can be accomplished in a plasma "ashing" step by the use of suitable plasma ashing gases. This typically occurs at high temperatures, for example, above 200° C. Ashing converts most of the organic residues to volatile species, but leaves behind on the substrate a predominantly inorganic residue. Such residue typically remains not only on the surface of the substrate, but also on inside walls of vias that may be present. As a result, ash-treated substrates are often treated with a cleaning composition typically referred to as a "liquid stripping composition" to remove the highly adherent residue from the substrate. Finding a suitable cleaning composition for removal of this residue without adversely affecting, e.g., corroding, dissolving or dulling, the metal circuitry has also proven problematic. Failure to completely remove or neutralize the residue can result in discontinuances in the circuitry wiring and undesirable increases in electrical resistance.

Conventional stripping compositions typically comprise (a) a fluorine ion source, such as ammonium fluoride; (b) a solvent; (c) a pH buffer system; and, optionally, (d) water. (See, for example, U.S. Pat. No. 5,698,503 (Ward), U.S. Pat. No. 6,821,352 (Rovito), US 2004/0016904 (Baum), and U.S. Pat. No. 6,773,873 (Seijo).) However, the formulation of the prior art cleaning compositions either significantly etches tetraethylorthosiliate (TEOS) and metals such as copper and aluminum, or are difficult to control at a pH that is compatible with porous interlayer dielectric materials and favorable to the cleaning resist and ash residue (i.e., a pH of about 6.0).

Therefore, there is a need in the art for a cleaning composition that effectively cleans substrates constructed of porous interlayer dielectric, but does not significantly etch TEOS, porous low-k dielectrics or metals such as copper.

BRIEF SUMMARY OF THE INVENTION

The present invention provides cleaning compositions comprising a fluoride ion source, a pH buffer system comprising a polyprotic acid having at least three carboxylic groups and its conjugate base; at least one polyhydric alcohol; and water. Preferably, the polyprotic acid has a pKa value of about 5 to about 7. Such cleaning compositions are useful for removing residues, including the photoresist and polymeric residues, that form during etching or ashing processes in the manufacture of semiconductors. These cleaning compositions are particularly useful for removing such residues from semiconductor substrates comprising, e.g., TEOS, porous low-k dielectrics and/or copper.

Thus, a general objective of the invention is to provide a semiconductor substrate cleaning composition that is effective at removing photoresist and polymeric residues from integrated circuits, but that is compatible with the semiconductor's porous interlayer dielectric materials and has a low etch rate for oxides and for metals such as copper, aluminum, titanium, tungsten, and the like.

Applicant has surprisingly discovered that a polyprotic acid having at least three carboxylic acid groups and its conjugate base such as, for example, citric acid and ammonium citrate tribasic, are miscible in polyhydric solvents, such as, for example, glycerol, and that a semi-aqueous cleaning composition comprising such a polyprotic acid, conjugated base, and polyhydric solvent, when combined with a fluoride ion source and controlled to a pH of about from 6.2 to about 6.4, effectively clean porous interlayer dielectrics substrates without producing a significant etching effect on the substrate's copper layer or tetraethylorthosiliate (TEOS) and porous ILD. This is especially surprising in view of the fact that cleaning compositions formulated with conventional solvents such as dihydrics (i.e., glycols) or tetrahydrofurfuryl alcohol (THFA) are much more aggressive at etching copper and TEOS and also are less miscible with citric acid.

Accordingly, one aspect of the present invention is a composition for removing residue from a semiconductor substrate comprising a fluoride ion source; a pH buffer system comprising a polyprotic acid having at least three carboxylic acid groups and its conjugate base; at least one polyhydric alcohol solvent; and water.

According to another aspect of the present invention, provided is a method of removing a photoresist or residue coating from a substrate comprising contacting a semiconductor substrate having a polymeric or photoresist residue with a cleaning composition comprising fluoride ion source; pH buffer system comprising a polyprotic acid having at least three carboxylic acid groups and its conjugate base; at least one polyhydric alcohol; and water; and, subsequent to said contacting, removing at least a portion of said cleaning composition from said substrate to effectively remove at least a portion of said coating.

DETAILED DESCRIPTION OF THE INVENTION

The present invention is directed to semi-aqueous, acidic, buffered compositions and methods of using such composition to remove photoresist and/or etch or ash residue from the surface of a substrate of a semiconductor or microelectric device. As used herein, the term "semi-aqueous" refers to compositions that comprise both water and water-soluble organic components such as, e.g., organic solvents. The compositions of the present invention generally comprise, in effective cleaning amounts, an acidic buffer system, a polyhydric solvent that is miscible with water and the acid of the acidic buffer system, a fluoride source, and water. Preferably, the pH of these compositions is adjusted to between about 6.0 and about 6.6. The compositions may also optionally include a corrosion inhibitor and/or other additives known to those skilled in the art that are typically used in compositions for removing photoresist and/or etch or ash residue.

A. Buffer System:

The cleaning composition of the present invention comprises a buffer system to maintain the composition's pH, preferably at a slightly acidic pH of about 5.0 to about 7.0, and more preferably about 6.0 to about 6.6. Cleaning compositions having this pH range are effective at removing highly inorganic etch residues and oxide skimming, but have little corrosive effect on a semiconductor being cleaned. That is, a pH of this range is a preferred balance of cleaning efficacy of etch residue and compatibility with conductive metals such as, for example, copper, and with porous low-k interlayer dielectric materials, such as, for example, spin on and CVD porous low-k dielectrics and sensitive p-doped and undensified TEOS.

The buffer system comprises an acid and its conjugate base. It is believed that the buffer system produces a pH stabilizing effect as the result of a proton disassociation equilibrium that exists between the buffer's acid and its respective conjugate base. Without such a buffer system, dilution with water or contamination by bases or acids can cause the composition's pH to become too high or too low leading to significant variances in cleaning and substrate etching. For example, a semi-aqueous fluoride stripper at a pH of 4.75 may not etch copper significantly, but at a pH of 7.5 or higher may severely etch copper, causing unacceptable loss of a device-critical dimension.

In order to easily maintain the composition's pH and limit the potential for oxide etching and/or metal corrosion, acids of the buffering system of the present invention preferably have a pKa value within ±1 units of the desired pH (e.g., a pH of from about 6.2 to about 6.4). As used herein, a pKa (or acid dissociation constant) value corresponds to the level of dissociation of the acid in water at 25° C. and is a measure of the extent of dissociation or the strength of an acid. For weak acids, the pKa will equal the pH if the concentration of undissociated acid is equal to the concentration of the anion of the acid.

For example to maintain a desired pH of 6.4, the buffer system may comprise an acid, such as a citric acid which has a pK3 value of about 6.40. Preferably, acids of the buffer system have a pKa value of about 5 to about 7, more preferably from about 6.0 to about 6.6.

Preferred acids for the buffer system are polyprotic that have at least three carboxylic acid groups. Such acids have at least a second and a third dissociation constant, each of which is higher relative to its respective preceding constant. This indicates that the acid loses a first proton more easily than a second one, because the first proton separates from an ion of a single negative charge, whereas the second proton separates from the ion of a double negative charge. It is believed that the double negative charge strongly attracts the proton back to the acid ion. A similar relationship exists between the second and third separated protons. Thus, polyprotic acids such as, for example, those having at least three carboxylic acid groups are useful in controlling the pH of a solution, particularly at a pH corresponding to their higher pKa value. Therefore, in addition to having a pKa value of about 5 to about 7, preferred polyprotic acids of the present invention have multiple pKa values, wherein the highest pKa is from about 5 to about 7.

Polyprotic acids having at least three carboxylic acid groups according to the present invention are highly compatible with polyhydric solvents. Examples of preferred polyprotic acids include tricarboxylic acids (e.g., citric acid, 2-methylpropane-1,2,3-triscarboxylic, benzene-1,2,3-tricarboxylic[hemimellitic], propane-1,2,3-tricarboxylic[tricarballylic], 1,cis-2,3-propenetricarboxylic acid[aconitic], and the like), tetracarboxylic acids (e.g., butane-1,2,3,4-tetracarboxylic, cyclopentanetetra-1,2,3,4-carboxylic, benzene-1,2,4,5-tetracarboxylic[pyromellitic], and the like), pentacarboxlyic acids (e.g., benzenepentacarboxylic), and hexacarboxylic acids (e.g., benzenehexacarboxylic[mellitic]), and the like. The respective pKa values of these acids are provided in Table 1. Particularly preferred polyprotic acids include tricarboxylic acids, with citric acid being most preferred.

TABLE 1

| | pKa value at 25° C. | | | | | |
|---|---|---|---|---|---|---|
| Acid | pK1 | pK2 | pK3 | pK4 | pK5 | pK6 |
| Citric acid | 3.13 | 4.76 | 6.40 | | | |
| 2-Methylpropane-1,2,3-triscarboxylic | 3.53 | 5.02 | 7.20 | | | |

TABLE 1-continued

| Acid | pKa value at 25° C. | | | | | |
|---|---|---|---|---|---|---|
| | pK1 | pK2 | pK3 | pK4 | pK5 | pK6 |
| Benzene-1,2,3-tricarboxylic (hemimellitic) | 2.98 | 4.25 | 5.87 | | | |
| Propane-1,2,3-tricarboxylic (tricarballylic) | 3.67 | 4.84 | 6.20 | | | |
| 1,cis-2,3-Propenetricarboxylic acid, (aconitic) | 3.04 | 4.25 | 5.89 | | | |
| Butane-1,2,3,4-tetracarboxylic | 3.36 | 4.38 | 5.45 | 6.63 | | |
| Cyclopentanetetra-1,2,3,4-carboxylic | 3.07 | 4.48 | 5.57 | 10.06 | | |
| Benzene-1,2,4,5-tetracarboxylic (pyromellitic) | 2.43 | 3.13 | 4.44 | 5.61 | | |
| Benzenepentacarboxylic | 2.34 | 2.95 | 3.94 | 5.07 | 6.25 | |
| Benzenehexacarboxylic (mellitic) | 2.08 | 2.46 | 3.24 | 4.44 | 5.50 | 6.59 |

Citric acid, the preferred polyprotic acid, is a tricarboxylic acid having three pKa values: 3.13, 4.76, and 6.40, corresponding to trihydrogencitrate ions, dihydrogencitrate ions, and monohydrogen citrate ions, respectively. In certain preferred embodiments of the present invention, the buffer system comprises a salt of citric acid, with especially preferred buffers comprising aqueous solutions of ammonium citrate tribasic and citric acid.

Methods of preparing buffer systems are well known in the art. To achieve the desired pH, the buffer system is typically added to the cleaning composition in a step-wise fashion.

The preferred buffering system comprises a semi-aqueous solution of citric acid and ammonium citrate tribasic in a ratio of about 1:1 to about 1:20, and more preferably about 1:1 to about 1:10. Preferably the cleaning composition comprises citric acid and ammonium citrate tribasic in amounts effective to produce and maintain the composition's pH at about 6.0 to 6.6. In certain preferred embodiments, the cleaning composition comprises from about 0.1 to about 10 weight percent of a 29% solution of citric acid and from about 0.1 to about 40 weight percent of a 50% solution of ammonium citrate tribasic, or stoichiometric equivalent thereof. More preferably, the cleaning composition comprises from about 0.5 to about 1 weight percent of a 29% solution of citric acid and about 3.2 to about 6.4 weight percent of a 50% solution of ammonium citrate.

B. Solvent:

As used herein, the term polyhydric alcohol means a compound containing three or more hydroxyl groups. Polyhydric alcohols having three hydroxyl groups are referred to as trihydric alcohols (and are also commonly referred to as glycerols or glycerins). Polyhydric solvents for use with the present invention preferably are highly miscible with water and with the acid/conjugate base of the buffer system.

A particularly preferred polyhydric solvent is glycerol. Applicants have discovered that glycerol is not only miscible with the preferred citric acid/ammonium citrate tribasic buffer, but also has high hydrogen bonding capacities relative to conventional solvents such as glycols (i.e., dihyrdic alcohols) and other alcohols such as tetrahydrogen furfuryl alcohol (THFA). When incorporated into a cleaning composition according to the present invention, the high hydrogen bonding characteristic of glycerol minimizes the composition's propensity for etching sensitive metals such as copper, and silicon oxides such as, TEOS, and porous low-k dielectrics. Thus, in certain preferred embodiments, the solvent not only contains glycerol, but also is essentially free of monohydric and dihydric alcohols.

In certain embodiments the cleaning composition comprises from about 20 to about 99 weight percent of glycerol, more preferably from about 25 to about 50 weight percent glycerol, and even more preferably from about 30 to about 45 weight percent glycerol.

C. Fluoride Ion Source:

The cleaning composition of the present invention also comprises one or more sources of fluoride ion. Fluoride ion functions principally to assist in removing inorganic residues from the substrate. Typical compounds that provide a fluoride ion source according to the present invention are hydrofluoric acid and salts thereof, ammonium fluoride, quaternary ammonium fluorides such as, for example, tetramethylammonium fluoride and tetrabutylammonium fluoride, fluoroborates, fluoroboric acid, tetrabutylammonium tetrafluoroborate, and aluminum hexafluoride. A fluoride salt of an aliphatic primary, secondary or tertiary amine can be used. Examples of such amines are those having the formula:

$$R^1NR^2R^3R^4F$$

wherein $R^1$, $R^2$, $R^3$ and $R^4$ individually represent H or a ($C_1$-$C_4$) alkyl group. Typically, the total number of carbon atoms in the $R^1$, $R^2$, $R^3$ and $R^4$ groups is 12 carbon atoms or less.

In selecting the source of the fluoride ion, consideration should be given as to whether or not the source releases ions that would adversely affect the surface being cleaned. For example, in cleaning semiconductor elements, the presence of sodium or calcium ions in the cleaning composition can have an adverse effect on the surface of the element. In a preferred embodiment, the fluoride ion source is ammonium fluoride.

It is believed that the amount of the compound used as the source of the fluoride ion in the cleaning composition will, for most applications, comprise, about 0.1 to about 10% by weight of a solution 40% ammonium fluoride, or stoichiometric equivalent thereof. Preferably, the compound comprises from about 0.1 to about 3% by weight and, most preferably, from about 1.0% to about 2.5% by weight of a solution of about 40% ammonium fluoride. It should be understood that the amount of fluoride ion used will typically depend, however, on the particular substrate being cleaned. For example, in certain cleaning applications, the amount of the fluoride ion can be relatively high when cleaning substrates that comprise dielectric materials that have a high resistance to fluoride etching. Conversely, in other applications, the amount of fluoride ion should be relatively low, for example, when cleaning substrates that comprise dielectric materials that have a low resistance to fluoride etching.

D. Water

The cleaning composition of the present invention is aqueous-based and, thus, comprises water. In the present invention, water functions in various ways such as, for example, to dissolve one or more solid components of the composition, as a carrier of the components, as a cleaning agent in the removal of the inorganic residue, as a viscosity modifier of the composition, and as a diluent. Preferably, the water employed in the cleaning composition is de-ionized (DI) water.

It is believed that, for most applications, the cleaning composition will comprise, for example, from about 30 to about 90% by wt. of water. Other preferred embodiments of the present invention could comprise from about 40 to about 70% by wt. of water. Yet other preferred embodiments of the present invention could comprise from about 45 to about 65% by wt. of water. Still other preferred embodiments of the present invention could include water in an amount to achieve the desired weight percent of the other ingredients.

E. Optional Components:

The cleaning composition of the present invention may also include one or more of the following additives: corrosion inhibitors, surfactants, chelating agents, chemical modifiers, dyes, biocides, and other additives. The additive(s) may be added to the extent that they do not adversely affect the pH range of the composition.

Corrosion inhibitors can be added to compositions of the present invention. Corrosion inhibitors serve to react with the substrate surface being cleaned, which may be a metal, particularly copper, or a nonmetal, to passivate the surface and prevent excessive etching during cleaning. In particular and without being bound to any particular theory, it is believed that the corrosion inhibitor forms a coating of an insoluble chelate compound on the copper surface, thus suppressing contact between the photoresist residue removal component and the metal thereby preventing corrosion.

Any corrosion inhibitor known in the art for similar applications, such as those disclosed in U.S. Pat. No. 5,417,877, which are incorporated herein by reference, may be used. The use of a corrosion-inhibitor is particularly preferred when the composition is used to clean a metallic substrate. Examples of corrosion-inhibitors include aromatic hydroxyl compounds, acetylenic alcohols, carboxyl group-containing organic compounds and anhydrides thereof, and triazole compounds.

Exemplary aromatic hydroxyl compounds include phenol, cresol, xylenol, pyrocatechol, resorcinol, hydroquinone, pyrogallol, 1.2.4-benzenetriol, salicyl alcohol, p-hydroxybenzyl alcohol, o-hydroxybenzyl alcohol, p-hydroxyphenethyl alcohol, p-aminophenol, m-aminophenol, diaminophenol, amino resorcinol, p-hydroxybenzoic acid, o-hydroxybenzoic acid, 2,4-dihydroxybenzoic acid, 2-5-dihydroxybenzoic acid, 3,4-dihydroxybenzoic acid and 3,5-dihydroxybenzoic acid.

Exemplary acetylenic alcohols include 2-butyne-1,4-diol, 3,5-dimethyl-1-hexyn-3-ol, 2-methyl-3-butyn-2-ol, 3-methyl-1-pentyn-3-ol, 3,6-dimethyl-4-octyn-3,6-diol, 2,4-7,9-tetramethyl-5-decyne-4,7-diol and 2,5-dimethyl-3-hexyne 2,5-diol.

Exemplary carboxyl group-containing organic compounds and anhydrides thereof include formic acid, acetic acid, propionic acid, butyric acid, isobutyric acid, oxalic acid, malonic acid, succinic acid, glutaric acid, maleic acid, fumaric acid, benzoic acid, phthalic acid, 1,2,3-benzenetricarboxylic acid, glycolic acid, lactic acid, maleic acid, acetic anhydride and salicylic acid.

Exemplary triazole compounds include benzotriazole, o-tolyltriazole, m-tolyltriazole, p-tolyltriazole, carboxybenzotriazole, 1-hydroxybenzotriazole, nitrobenzotriazole and dihydroxypropylbenzotriazole.

Preferred inhibitors are catechol, gallic acid, benzotriazole, pyrogallol, 4-methyl catechol fumaric acid and diethylhydroxylamine (DEHA); it is preferred that an inhibitor other than benzotriazole be used when cleaning a substrate comprising copper because benzotriazole has a tendency to bind to copper.

It is believed that for most applications, the corrosion-inhibitor will comprise from about 0.1 wt. % to about 15 wt. % of the composition; preferably it comprises from about 0.1 wt. % to about 10 wt. %, most preferably, from about 0.5 wt. % to about 5 wt. % of the composition.

Another optional ingredient that can be used in the cleaning composition is a metal chelating agent; it can function to increase the capacity of the composition to retain metals in solution and to enhance the dissolution of metallic residues. Typical examples of chelating agents useful for this purpose are the following organic acids and their isomers and salts: ethylenediaminetetraacetic acid (EDTA), butylenediaminetetraacetic acid, (1,2-cyclohexylenediamine)tetraacetic acid (CyDTA), diethylenetriaminepentaacetic acid (DETPA), ethylenediaminetetrapropionic acid, (hydroxyethyl)ethylenediaminetriacetic acid (HEDTA), N, N,N',N'-ethylenediaminetetra(methylenephosphonic) acid (EDTMP), triethylenetetraminehexaacetic acid (TTHA), 1,3-diamino-2-hydroxypropane-N,N,N',N'-tetraacetic acid (DHPTA), methyliminodiacetic acid, propylenediaminetetraacetic acid, nitrotriacetic acid (NTA), citric acid, tartaric acid, gluconic acid, saccharic acid, glyceric acid, oxalic acid, phthalic acid, maleic acid, mandelic acid, malonic acid, lactic acid, salicylic acid, catechol, gallic acid, propyl gallate, pyrogallol, 8-hydroxyquinoline, and cysteine. Preferred chelating agents are aminocarboxylic acids such as EDTA, CyDTA and aminophosphonic acids such as EDTMP.

It is believed that, for most applications, the chelating agent will be present in the composition in an amount of from about 0.1 wt. % to about 10 wt. %, preferably in an amount of from about 0.5 wt. % to about 5 wt. % of the composition.

Other commonly known components such as dyes, biocides etc. can be included in the cleaning composition in conventional amounts, for example, amounts up to a total of about 5 weight % of the composition.

The cleaning composition of the present invention is typically prepared by mixing the components together in a vessel at room temperature until all solids have dissolved in the aqueous-based medium.

F. Method of Cleaning:

The cleaning composition of the present invention can be used to remove an undesired residue from a substrate. Preferably, the composition is used to clean residue from a semiconductor substrate that is deposited or formed during a semiconductor manufacturing process. Examples of such residue include resist compositions in the form of films (both positive and negative) and etching deposits formed during dry etching, as well as chemically degraded resist films. The use of the composition is particularly effective when the residue to be removed is a resist film and/or an etching and/or ashing deposit on a semiconductor substrate constructed of porous interlayer dielectric materials and having a metal film-exposed surface. Examples of substrates that can be cleaned by use of the composition of the present invention without attacking the substrates themselves include metal substrates, for example: copper, copper alloy, aluminum, aluminum alloy, titanium, titanium nitride, tantalum, tantalum nitride, tungsten, and titanium/tungsten, silicon nitride and gallium arsenide. Such substrates typically include residues comprising photoresists and/or post etch and/or ash deposits.

In addition to being effective when used to remove resist films and/or etching residues on a semiconductor wafer having an exposed surface of a metal film, the cleaning composition is especially effective when the metal film is made of copper or a copper alloy containing copper as the main component and also when a low-dielectric film is used as an interlayer insulating film.

The cleaning composition can be used to remove post-etch and ash, other organic and inorganic residues as well as polymeric residues from semiconductor substrates at relatively low temperatures with little corrosive effect. The cleaning composition should be applied to the surface for a period of time to sufficient to obtain the desired cleaning effect. The time will vary depending on numerous factors, including, for example, the nature of the residue, the temperature of the cleaning composition, and the particular cleaning composition used. In general, the cleaning composition can be used, for example, by contacting the substrate at a temperature of from about 25° C. to about 85° C. for a period of time ranging from about 1 minute to about 1 hour followed by rinsing the cleaning composition from the substrate and drying the substrate.

The contacting step can be carried out by any suitable means such as, for example, immersion, spray, or via a single wafer process; any method that utilizes a liquid for removal of photoresist, ash or etch deposits and/or contaminants can be used.

The rinsing step is carried out by any suitable means, for example, rinsing the substrate with de-ionized water by immersion or spray techniques.

The drying step is carried out by any suitable means, for example, isopropyl alcohol (IPA) vapor drying or by nitrogen blow dry.

It will be appreciated by those skilled in the art that the cleaning composition of the present invention may be modified to achieve optimum cleaning without damaging the substrate so that high throughput cleaning can be maintained in the manufacturing process. For example, one skilled in the art would appreciate that, for example, modifications to the amounts of some or all of the components may be made depending upon the composition of the substrate being cleaned, the nature of the residue to be removed, and the particular process parameters used.

Although the present invention has been principally described in connection with cleaning semiconductor substrates, the cleaning compositions of the invention can be employed to clean any substrate that includes organic and inorganic residues.

EXAMPLES

The following examples are provided for the purpose of further illustrating the present invention but are by no means intended to limit the same.

Examples 1-5 and Comparative Examples A-F

These examples demonstrate the effective Cu etch rate of certain embodiments of cleaning compositions according to the present invention (i.e., cleaning compositions comprising a polyprotic acid buffer system in a polyhydric alcohol solvent). For comparison, also shown are the etch rates of certain cleaning compositions having a dicarboxylic acid buffer system.

The cleaning compositions described in Examples 1-5 were separately prepared by mixing a polyhydric alcohol solvent (glycerol or a mixture of glycerol and THFA), deionized water, a tricarboxylic acid (29 wt. % percent aqueous solution of citric acid), a base (50 wt. % aqueous solution of ammonium citrate tribasic), and a fluoride ion source (40 wt. % aqueous solution of ammonium fluoride) in the ratios identified in Table A at room temperature. These cleaning solutions represent various embodiments of the present invention.

Additional cleaning compositions (Comparative Examples A-F) were prepared as described in Table B. In contrasts to the cleaning compositions of Examples 1-5, the comparative cleaning compositions comprise a dicarboxylic acid buffer system (i.e., adipic acid or maleic acid and ammonium hydroxide or monoethanolamine) and, in some cases, a non-polyhyrdic alcohol solvent (dimethylacetamide).

Coupons of blanketed Cu wafers were obtained and measured for metal layer thickness by measuring the resistivity of the layer by employing a ResMap™ model 273 resistivity instrument from Creative Design Engineering, Inc. A first and second coupon for each cleaning composition of Examples 1-5 and Comparative Examples A-F were selected and then immersed in that composition at 25° C. for 5 and 20 minutes, respectively. After the specified time, the coupons were removed from the composition, rinsed with de-ionized water and dried and the thickness of the metal layer was again measured. The change in Cu thickness in angstroms was determined and is provided for the Examples and Comparative Examples in Tables A and B, respectively.

As shown in Table A, cleaning compositions comprising a tricarboxylic acid buffer system in glycerol have a Cu etch depth of 5-12 angstroms after a 5 minute immersion at 25° C. A cleaning composition comprising a tricarboxylic acid buffer system in glycerol/THFA has a Cu etch depth of 16 angstroms under similar conditions. The dicarboxylic acid buffer systems, on the other hand, had a Cu etch depth of 17-53 angstroms after a 5 minute immersion at 25° C. (Table B). These results demonstrate that tricarboxylic acid buffer systems (e.g., citric acid and its conjugate base) have a lower etch rate and, thus, are better suited for cleaning compositions, compared to dicarboxylic acid buffer systems.

TABLE A

| | Wt. % | pH | Cu thickness Å etched at 25° C. for 5 min. immersion | Cu thickness Å etched at 25° C. for 20 min. immersion |
|---|---|---|---|---|
| Example 1 (AW 19650-83M) | | 6.25 | 7 | 33 |
| Glycerol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Example 2 (AW19650-87D) | | 6.20 | 16 | 65 |
| Glycerol | 37.0 | | | |
| THFA | 12.3 | | | |
| DIW | 45.0 | | | |
| Citric Acid (29% solution) | 0.5 | | | |

TABLE A-continued

| | Wt. % | pH | Cu thickness Å etched at 25° C. for 5 min. immersion | Cu thickness Å etched at 25° C. for 20 min. immersion |
|---|---|---|---|---|
| Ammonium citrate tribasic (50% solution) | 3.2 | | | |
| Ammonium fluoride (40% solution) | 2.0 | | | |
| Example 3 (AW19650-87E) | | 6.21 | 10 | 30 |
| Glycerol | 46.0 | | | |
| DIW | 48.3 | | | |
| Citric Acid (29% solution) | 0.5 | | | |
| Ammonium citrate tribasic (50% solution) | 3.2 | | | |
| Ammonium fluoride (40% solution) | 2.0 | | | |
| Example 4 (AW19650-87F) | | 6.22 | 5 | 32 |
| Glycerol | 39.3 | | | |
| DIW | 55.0 | | | |
| Citric Acid (29% solution) | 0.5 | | | |
| Ammonium citrate tribasic (50% solution) | 3.2 | | | |
| Ammonium fluoride (40% solution) | 2.0 | | | |
| Example 5 (AW19650-87G) | | 6.32 | 12 | 35 |
| Glycerol | 29.3 | | | |
| DIW | 65.0 | | | |
| Citric Acid (29% solution) | 0.5 | | | |
| Ammonium citrate tribasic (50% solution) | 3.2 | | | |
| Ammonium fluoride (40% solution) | 2.0 | | | |

TABLE B

| | Wt. % | pH | Cu thickness Å etched at 25° C. for 5 min. immersion | Cu thickness Å etched at 25° C. for 20 min. immersion |
|---|---|---|---|---|
| Comparative Example A (AW20473-33A) | | 6.16 | 53 | 158 |
| Dimethylacetamide (DMAc) | 60.0 | | | |
| DIW | 29.8 | | | |
| Maleic Acid | 4.0 | | | |
| Ammonium hydroxide (28% solution) | 3.7 | | | |
| Ammonium fluoride (40% solution) | 2.5 | | | |
| Comparative Example B (AW20473-33B) | | 5.52 | 28 | 76 |
| Dimethylacetamide (DMAc) | 60.0 | | | |
| DIW | 32.5 | | | |
| Adipic Acid | 3.0 | | | |
| Monoethanolamine (MEA) | 2.0 | | | |
| Ammonium fluoride (40% solution) | 2.5 | | | |
| Comparative Example C (AW20473-33C) | | 6.42 | 24 | 71 |
| Glycerol | 45.3 | | | |
| DIW | 45.0 | | | |
| Maleic Acid | 4.0 | | | |
| Ammonium hydroxide (28% solution) | 3.7 | | | |
| Ammonium fluoride (40% solution) | 2.0 | | | |
| Comparative Example D (AW20473-33E) | | 5.54 | 17 | 45 |
| Glycerol | 48.0 | | | |
| DIW | 45.0 | | | |
| Adipic Acid | 3.0 | | | |
| Monoethanolamine (MEA) | 2.0 | | | |
| Ammonium fluoride (40% solution) | 2.0 | | | |
| Comparative Example E (AW20473-33F) | | 6.42 | 29 | 86 |
| Glycerol | 34.0 | | | |
| THFA | 11.3 | | | |
| DIW | 45.0 | | | |
| Maleic Acid | 4.0 | | | |
| Ammonium hydroxide (28% solution) | 3.7 | | | |
| Ammonium fluoride (40% solution) | 2.0 | | | |
| Comparative Example F (AW20473-33H) | | 5.60 | 24 | 61 |
| Glycerol | 36.0 | | | |
| THFA | 12.0 | | | |
| DIW | 45.0 | | | |
| Adipic Acid | 3.0 | | | |
| Monoethanolamine (MEA) | 2.0 | | | |
| Ammonium fluoride (40% solution) | 2.0 | | | |

Examples 6-8

These examples demonstrate the cleaning efficacy of cleaning compositions according to the present invention.

The cleaning compositions described in Table C were prepared in a manner similar to that used to prepare the cleaning compositions of Examples 1-5.

The substrate to be cleaned comprised TEOS and Coral ULK layers coated on a silicon substrate. The substrate has been post etched and ashed in order to make trench pattern.

The cleaning processes were performed using 300 mL of each cleaning compositions, described in Table C placed in 400 mL beakers with a ½" round Teflon stir bar set at 600 rpm. The cleaning compositions maintained at either 25° C. or 40° C. as indicated in Table C. Wafer segments approximately ½"×½" in size were immersed in the compositions at the desired temperature for either 3 or 10 minutes as indicated in Table C.

The segments were then rinsed for 3 minutes in a DI water overflow bath and subsequently dried using filtered nitrogen. They were then analyzed for cleanliness using SEM microscopy. In addition, the cleaning composition's compatibility with the interlayer dielectric material was observed.

The test results demonstrate that the cleaning solutions of the present invention can effectively clean a substrate without damaging the substrate's interlayer dielectrics (ILDs).

Examples 9-14

These examples demonstrate the effective etch rate of phosphorus doped, undensified tetraethylorthosilicate (TEOS) etch rate and of porous diethyoxymethylsilane (PDEMS®) by certain cleaning composition embodiments of the present invention.

The cleaning compositions described in Table D were prepared in a manner similar to the method used to prepare the cleaning compositions of Examples 1-5.

Coupons of blanket doped undensified TEOS wafers and PDEMS® 2.5 wafers, which is a porous CVD low-k (k=2.5) film provided by Air Products and Chemicals, Inc., were obtained and their blanket thickness determined using a FilmTek 2000 SE Spectroscopic Ellipsometer/Reflectomer. Separate TEOS coupons, PDEMS® coupons and Cu coupons were immersed in each cleaning composition at a temperature of 25° C. At intervals of 5, 10, 20, 40, and 60 minutes of exposure, the coupons were removed from the composition, rinsed with de-ionized water, dried and the thickness of the blanket layers were measured again. Prior to thickness measurement, the TEOS and PDEMS® coupon were baked at a temperature of 110° C. for approximately 10 minutes For each exemplary composition, thickness measurements determined at each time interval were graphed using a "least squares fit" model. The calculated slope of the "least squares

TABLE C

| | Wt. % | Time and Temp. | Cleanability | ILD Damage |
|---|---|---|---|---|
| Example 6 (AW 19650-83M) | | | | |
| Glycerol | 45.6 | 3 min. at 25° C. | Yes | No |
| DIW | 45.0 | | | |
| Citric Acid (29% solution) | 1.0 | 3 min. at 40° C. | Yes | No |
| Ammonium citrate tribasic (50% solution) | 6.4 | | | |
| Ammonium fluoride (40% solution) | 2.0 | 10 min. at 40° C. | Yes | No |
| Example 7 (AW19650-87D) | | | | |
| Glycerol | 37.0 | 3 min. at 25° C. | Yes | No |
| THFA | 12.3 | | | |
| DIW | 45.0 | 3 min. at 40° C. | Yes | No |
| Citric Acid (29% solution) | 0.5 | | | |
| Ammonium citrate tribasic (50% solution) | 3.2 | 10 min. at 40° C. | Yes | No |
| Ammonium fluoride (40% solution) | 2.0 | | | |
| Example 8 (AW19650-87F) | | | | |
| Glycerol | 39.3 | 3 min. at 25° C. | Yes | No |
| DIW | 55.0 | | | |
| Citric Acid (29% solution) | 0.5 | 3 min. at 40° C. | Yes | No |
| Ammonium citrate tribasic (50% solution) | 3.2 | | | |
| Ammonium fluoride (40% solution) | 2.0 | 10 min. at 40° C. | Yes | No |

fit" model of each composition is the resultant etch rate provided in Table D in angstroms/minute (Å/min).

These test results demonstrate that the cleaning compositions have a TEOS etch rate and Cu etch rate of 1-2 angstroms/min at 250° C. and a PDEMS® etch rate of less than 1 angstroms/min at 25° C. which is acceptable for semiconductor cleaning processes.

TABLE D

| | Wt. % | pH | Cu etch rate (Å/min) at 25° C. | TEOS etch rate (Å/min) at 25° C. | PDEMS ® etch rate (Å/min) at 25° C. |
|---|---|---|---|---|---|
| Example 9 (AW19650-83M) | | 6.25 | 1 | 2 | <1 |
| Glycerol | 45.6 | | | | |
| DIW | 45.0 | | | | |
| Citric Acid (29% solution) | 1.0 | | | | |
| Ammonium citrate tribasic (50% solution) | 6.4 | | | | |
| Ammonium fluoride (40% solution) | 2.0 | | | | |
| Example 10 (AW19650-87D) | | 6.20 | 2 | 2 | <1 |
| Glycerol | 37.0 | | | | |
| THFA | 12.3 | | | | |
| DIW | 45.0 | | | | |
| Citric Acid (29% solution) | 0.5 | | | | |
| Ammonium citrate tribasic (50% solution) | 3.2 | | | | |
| Ammonium fluoride (40% solution) | 2.0 | | | | |
| Example 11 (AW19650-87E) | | 6.21 | 1 | 1 | <1 |
| Glycerol | 46.0 | | | | |
| DIW | 48.3 | | | | |
| Citric Acid (29% solution) | 0.5 | | | | |
| Ammonium citrate tribasic (50% solution) | 3.2 | | | | |
| Ammonium fluoride (40% solution) | 2.0 | | | | |
| Example 12 (AW19650-87F) | | 6.22 | 1 | 1 | <1 |
| Glycerol | 39.3 | | | | |
| DIW | 55.0 | | | | |
| Citric Acid (29% solution) | 0.5 | | | | |
| Ammonium citrate tribasic (50% solution) | 3.2 | | | | |
| Ammonium fluoride (40% solution) | 2.0 | | | | |
| Example 13 (AW19650-87G) | | 6.32 | 1 | 1 | <1 |
| Glycerol | 29.3 | | | | |
| DIW | 65.0 | | | | |
| Citric Acid (29% solution) | 0.5 | | | | |
| Ammonium citrate tribasic (50% solution) | 3.2 | | | | |
| Ammonium fluoride (40% solution) | 2.0 | | | | |

Example 15 and Comparative Examples G-L

These examples demonstrate the effective Cu and TEOS etch rate for a tricarboxylic acid buffer system (citric acid/ammonium citrate tribasic) in a polyhydric solvent (i.e., glycerol) and, for comparison, the effective Cu and TEOS etch rate for the same tricarboxylic acid buffer system in dihydric solvents (i.e., various glycols) and tetrahydrogen furfuryl alcohol (THFA).

The cleaning compositions described in Example 15 and Comparative Examples G-L were prepared in a manner similar to the method used to prepare the cleaning compositions of Examples 1-5.

Coupons were measured for TEOS and Cu layer thicknesses. A coupon for each of the indicated cleaning compositions was immersed in that composition at 25° C. for 60 minutes. The coupons were then removed from the composition, rinsed with de-ionized water and dried and the thicknesses of the TEOS layer and the Cu layer were again measured. The changes in Cu thickness and TEOS thickness (in angstroms) were determined and are provided in Table E. The hydrogen bonding capability (also referred to as ΔH) of each solvent (cited from a reference book) is also provided in Table E.

The data in Table E demonstrates that, compared to non-polyhydric solvents, glycerol unexpectedly provides the best solubility in a cleaning composition comprising citric acid (as denoted by the high hydrogen bonding capability—i.e., higher ΔH). Moreover, compared to non-polyhydric solvents, cleaning compositions comprising glycerol unexpectedly produce the least etching effect on a substrate comprising copper and TEOS.

TABLE E

| | wt. % | ΔH | Cu thickness (Å) at 25° C. for 1 hour immersion | TEOS thickness (Å) at 25° C. for 1 hour immersion |
|---|---|---|---|---|
| Example 15 (AW 19650-83M) | | 29.3 | 27 | 179 |
| Glycerol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |

TABLE E-continued

| | Wt. % | ΔH | Cu thickness (Å) | TEOS thickness (Å) |
|---|---|---|---|---|
| Comparative Example G (AW19650-14B) | | 26.0 | 45 | 249 |
| Ethylene Glycol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Comparative Example H (AW19650-14A) | | 23.3 | 55 | 224 |
| Propylene Glycol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Comparative Example I (AW19650-14D) | | 20.5 | 34 | 241 |
| Diethylene Glycol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Comparative Example J (AW19650-14E) | | 18.4 | 100 | 234 |
| Dipropylene Glycol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Comparative Example K (AW19650-14C) | | 17.8 | 153 | 332 |
| Hexylene Glycol | 45.6 | | | |
| DIW | 45.0 | | | |
| Citric Acid (29% solution) | 1.0 | | | |
| Ammonium citrate tribasic (50% solution) | 6.4 | | | |
| Ammonium fluoride (40% solution) | 2.0 | | | |
| Comparative Example L (AW19650-83D) | | 10.2 | 88 | 417 |
| Tetrahydrogen Furfuryl Alcohol | 37.0 | | | |
| THFA | 12.3 | | | |
| DIW | 45.0 | | | |
| Citric Acid (29% solution) | 0.5 | | | |
| Ammonium citrate tribasic (50% solution) | 3.2 | | | |
| Ammonium fluoride (40% solution) | 2.0 | | | |

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A composition for removing residue from a semiconductor substrate comprising:

a. a fluoride ion source;

b. a pH buffer system comprising a polyprotic acid having at least three carboxylic acid groups and its conjugate base;

c. a glycerol solvent essentially free of monohydric and dihydric alcohols; and d. water.

2. The composition of claim 1 wherein said polyprotic acid has a pKa value of about 5 to about 7.

3. The composition of claim 2 wherein said pKa value is from about 6.0 to about 6.6.

4. The composition of claim 1 having a pH of about 6.2 to about 6.4.

5. The composition of claim 1 wherein said polyprotic acid is a tricarboxylic acid.

6. The composition of claim 5 wherein said tricarboxylic acid is citric acid.

7. The composition of claim 6 wherein said conjugate base is ammonium citrate tribasic.

8. The composition of claim 1 wherein said fluoride ion source is selected from the group consisting of ammonium fluoride, hydrofluoric acid, tetramethylammonium fluoride, tetrabutylammonium fluoride, fluoroborates, fluoroboric acid, aluminum hexafluoride, methylamine hydrofluoride, ethylamine hydrofluoride, propylamine hydrofluoride and a fluoride salt of an aliphatic primary, secondary or tertiary amine having the formula $R^1N(R^2)R^3F$, wherein $R^1$, $R^2$ and $R^3$ each represent individually H or a $(C_1\text{-}C_4)$ alkyl group.

9. The composition of claim 8 wherein said fluoride ion source is ammonium fluoride.

10. The composition of claim 1 wherein said fluoride ion source is ammonium fluoride, said pH buffer system is a citric acid and ammonium citrate tribasic solution, and said solvent is a glycerol.

11. The composition of claim 1 further comprising a corrosion inhibitor selected from the group consisting of aromatic hydroxyl compounds, acetylenic alcohols, carboxyl group containing organic compounds and anhydrides thereof, triazole compounds, and mixtures thereof.

12. The composition of claim 11 wherein said corrosion inhibitor is selected from the group consisting of catechol, gallic acid, pyrogallol, 4-methyl catechol, fumaric acid, diethylhydroxylamine, and mixtures thereof.

13. The composition of claim 1 consisting essentially of ammonium fluoride, a citric acid and ammonium citrate tribasic solution, water, and glycerol.

14. The composition of claim 1 consisting essentially of from about 20 to about 99 weight percent glycerol; from about 30 to about 90 weight percent water; from about 0.1 to about 10 weight percent of a 29% solution of citric acid or stoichiometric equivalent thereof; from about 0.1 to about 40 weight percent of a 50% solution of ammonium citrate tribasic or stoichiometric equivalent thereof; and from about 0.1 to about 10 weight percent of a 40% solution of ammonium fluoride or stoichiometric equivalent thereof.

15. The composition of claim 14 consisting essentially of from about 25 to about 50 weight percent glycerol; from about 40 to about 70 weight percent water; from about 0.5 to about 1.5 weight percent of a 29% solution of citric acid; from about 3 to about 7 weight percent of a 50% solution of ammonium citrate tribasic; and from about 1 to about 5 weight percent of 40% solution of ammonium fluoride.

16. A method of removing a photoresist or residue coating from a substrate comprising:

a. contacting a substrate having a polymeric or photoresist residue with a cleaning composition according to claim 1; and b. subsequent to said contacting, removing at least a portion of said cleaning composition from said substrate to effectively remove at least a portion of said coating.

17. The method of claim 16 wherein said substrate is a semiconductor substrate.

18. The method of claim 17 wherein said semiconductor substrate comprises copper.

19. The method of claim 16 wherein said residue results from an ashing process.

20. The method of claim 16 wherein said removing involves rinsing said substrate with water.

21. The method of claim 16 wherein said substrate includes porous low-k dielectrics.

* * * * *